US005160390A

United States Patent [19]

Yukumoto et al.

[11] Patent Number: 5,160,390

[45] Date of Patent: Nov. 3, 1992

[54] RAPIDLY SOLIDIFIED FE-CR-AL ALLOY FOIL HAVING EXCELLENT ANTI-OXIDATION PROPERTIES

[75] Inventors: Masao Yukumoto; Michiharu Ozawa; Kazuhide Ishii; Hiroshi Shimizu, all of Chiba, Japan

[73] Assignee: Kawasaki Steel Corporation, Japan

[21] Appl. No.: 757,313

[22] Filed: Sep. 10, 1991

[30] Foreign Application Priority Data

Sep. 12, 1990 [JP] Japan ..... 2-240035

[51] Int. Cl.[5] ..... C22C 38/06

[52] U.S. Cl. ..... 148/325; 420/62; 428/606

[58] Field of Search ..... 420/62; 148/325; 428/606

[56] References Cited

FOREIGN PATENT DOCUMENTS 2070642 9/1981 United Kingdom ..... 420/62

*Primary Examiner*—Deborah Yee

*Attorney, Agent, or Firm*—Austin R. Miller

[57] ABSTRACT

A rapidly solidified Fe-Cr-Al alloy foil having excellent anti-oxidation properties, the foil essentially consisting of Cr: about 5 to 30 wt %, Al: about 2 to 15 wt %, Si: about 1.5 to 3 wt %, and REM (Y, Ce, La, Pr, Nd): about 0.07 to 2.0 wt %, the balance being Fe and impurities. The foil may further contain about 0.001 to 0.5 wt % of at least one element selected from the group consisting of Ti, Nb, Zr and V. The foil has a grain size of not more than about 10 μm. Preferably, the rapidly solidified alloy foil has a thickness of about 20 to 200 μm.

4 Claims, 1 Drawing Sheet

RAPIDLY SOLIDIFIED FE-CR-AL ALLOY FOIL HAVING EXCELLENT ANTI-OXIDATION PROPERTIES

BACKGROUND OF THE INVENTION

1. Field of the Invention

The present invention relates to an Fe—Cr—Al alloy foil which is produced by a rapidly solidifying process and which has resistance to high-temperature oxidation. Typical such materials are honeycomb materials used in exhaust gas converters of vehicles, and high-temperature heaters, or resistor materials.

2. Description of the Related Art

Various proposals have been hitherto made concerning Fe—Cr—Al alloys. For instance, Japanese Patent Laid-Open No. 58-177437 (U.S. Pat. No., 4,414,023) proposes an alloy containing Cr: 8 to 25 % by weight (hereinafter abbreviated to "wt %"), Al: 3 to 8 wt %, and all the rare-earth elements: up to 0.06 wt % with 0.002 to 0.05 wt % of Ce, La and Nd, the alloy further containing Si, Cu, Ni and the like added to improve anti-scale-peeling properties. The alloy is produced by performing cold rolling after hot rolling. In general, such an Fe—Cr—Al—REM alloy is used in, for instance, an exhaust gas converter of a vehicle, a resistor heater, or a radiation heater supporting member. However, when a foil obtained by a common rolling method, such as above, is used to form, for instance, a catalyst substrate in automotive exhaust gas systems of a vehicle with a width of not less than 50 mm, many problems arise if the converter is close to the engine where the temperature surrounding the converter is higher than normal. The converter is subjected to severe high-temperature, repeated oxidation and violent vibration each time the vehicle starts, accelerates or stops, resulting in oxide scales peeling off, thereby rendering the converter short-lived. With a common rolling method, it is technically difficult to produce a high Cr—Al foil having resistance sufficiently high to endure such environment. Further, heat treatment and cold rolling have to be repeatedly conducted, inevitably requiring high production costs.

In view of the above problems, the present inventors have previously cast their attention on a rapidly solidifying foil-production method in which rolling is omitted, and proposed to increase the amount of rare earth elements added so that anti-oxidation properties will be improved. To produce a foil by a rapidly solidifying method enables a high Cr—Al material, whose working is difficult, to be easily formed into sheets, and also assures a reduction in cost as well as a remarkable improvement in anti-oxidation properties. For instance, in Japanese Patent Laid-Open No. 63-42347, the present inventors have proposed to add rare earth materials or rare earth elements (REM) in a large amount of 0.06 to 0.30 wt % and to directly produce a foil by a rapidly solidifying method so that resistance to peeling of oxide film will be improved. In Japanese Patent Laid-Open No. 63-42356, the present inventors have proposed a rapidly solidifying method in which the content of Al is set within the range from 8 to 15 wt % so that anti-oxidation properties will be improved.

The addition of a large amount of REM or the method in which a high Al alloy is rapidly solidified does not involve any problem when such is performed on a laboratory scale, for instance, performed to produce narrow foils with a size of heating lot of 10 to 100 g, a foil width of 10 mm and a thickness of 50 μm. However, said addition or said method entails various problems when applied to industrial-scale production of foils for use as materials in an exhaust gas converter of a vehicle, the foils having a width of not less than 50 mm and a size of heating lot of not less than 10 kg; that is, problems such as the clogging of nozzles, a decrease in the REM amount, and the occurrence of internal defects, arise. For these reasons, the proposals have not yet been reduced to practice.

SUMMARY OF THE INVENTION

An object of the present invention is to provide an Fe—Cr—Al alloy foil which has excellent workability and anti-oxidation properties and which is produced by a rapidly solidifying method, the production of the foil being free from the risk of nozzle clogging and being stable.

DESCRIPTION OF THE DRAWING

The single drawing illustrates the degree of oxidation ($mg/cm^2$) of Fe—Cr—Al alloy foils according to the present invention as well as that of conventional Fe—Cr—Al alloy foils, the degree of oxidation being plotted against the lapse of time.

As a result of the present inventors' studies, which they conducted with a view to overcoming the above problems, they have found that it is very effective to add REM in an amount of not less than about 0.07 wt % (an amount greater than normal for rolling) to thereby improve the anti-oxidation properties of an Fe—Cr—Al alloy foil, and to add Si in a particular amount exceeding the conventional amount while effecting rapid solidification at a cooling speed at least equal to a predetermined value. This reduces the risk of nozzle clogging even with rapid solidification and moreover improves the surface properties of the foil and reduce internal defects.

Figure 1:
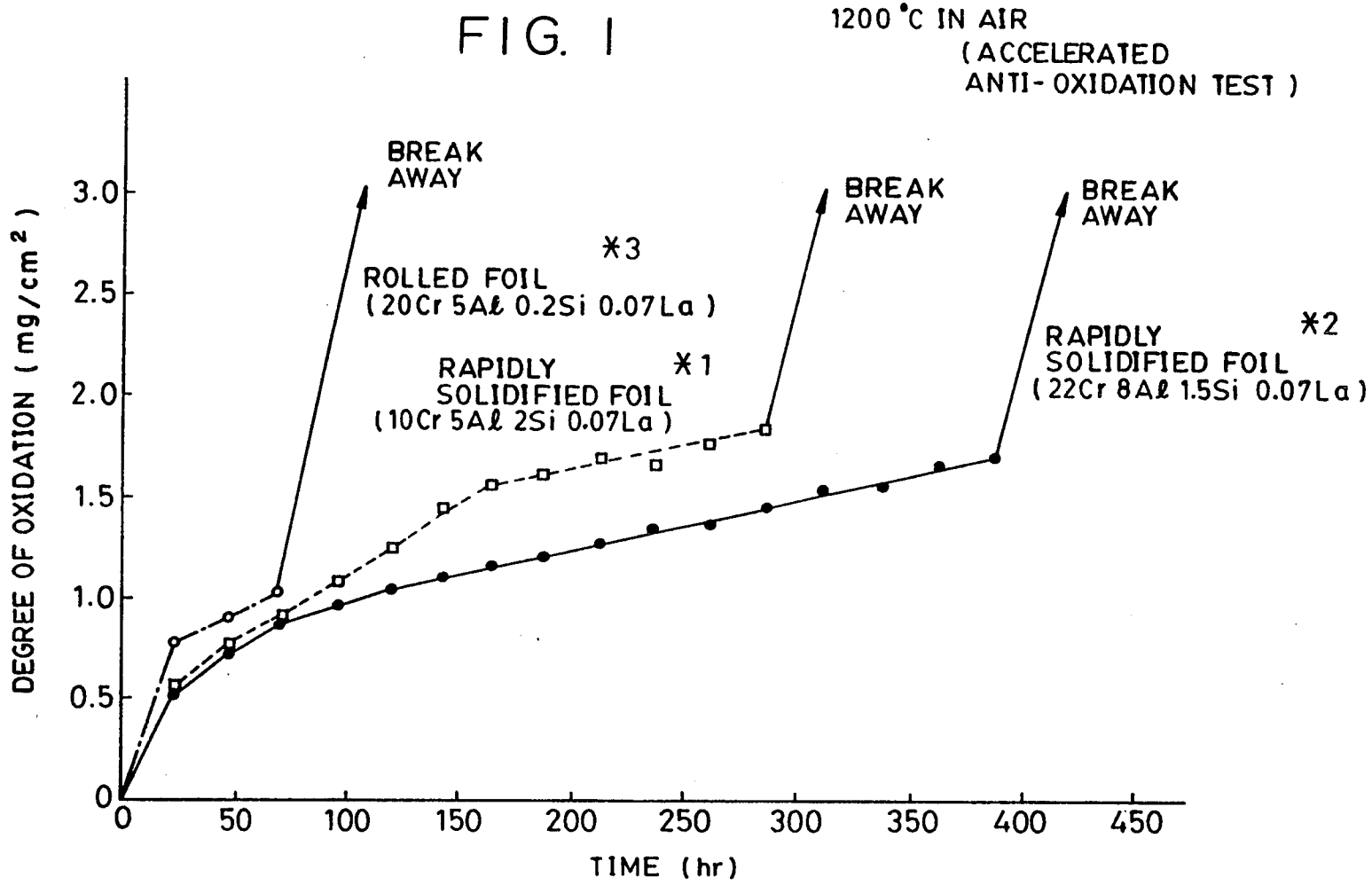

The present invention provides a rapidly solidified Fe—Cr—Al alloy foil having excellent anti-oxidation properties, the foil essentially consisting of Cr: 5 to 30 wt %, Al: 2 to 15 wt %, Si: 1.5 to 3 wt %, and REM (Y, Ce, La, Pr, Nd): 0.07 to 2.0 wt %, the foil further containing, if required, 0.001 to 0.5 wt % of at least one element selected from the group consisting of Ti, Nb, Zr and V, the balance being Fe and inevitable impurities, the foil having a grain size of not more than 10 μm. Preferably, the rapidly solidified alloy foil has a thickness of 20 to 200 μm.

The following gives the reasons why the chemical composition of a foil according to the present invention are contained within the respective ranges limited as above.

Cr: about 5 to 30 wt %.

If the Cr content is less than about 5 wt %, it is difficult to obtain desired anti-oxidation properties even if not less than 1.5 wt % of Si and not less than 0.07 wt % of rare earth element(s) are added (the rare-earth elements—REM —will be described later). On the other hand, if the Cr content is more than about 30 wt %, nozzle clogging tends to occur during rapid solidification and, in addition, the produced foil may be so brittle and have such poor workability that it cannot be bent by 180°. For these reasons, the Cr content is limited within the range from about 5 to 30 wt %.

Al: about 2 to 15 wt %.

If the Al content is less than about 2 wt %, it is difficult to assure desired anti-oxidation properties even if not less than 0.07 wt % of rare-earth element(s) are added. On the other hand, if the Al content exceeds about 15 wt %, workability may be deteriorated and, in addition, nozzle clogging tends to occur. Therefore, the Al content is limited within the range from about 2 to 15 wt %. In particular, in the production of foils for exhaust gas converters that have a thickness of about 20 to 80 μm, the addition of about 2 to 8 wt % of Al is preferable. In the production of, for instance, foils for heating resistors that have a thickness of not less than about 80 μm, since it is possible to adopt a single roll method and employ a nozzle having a large gap, and, hence, there is no risk of nozzle clogging, it is possible to add about 8 to 15 wt % of Al.

Si: about 1.5 to 3 wt %,

In the present invention, nozzle clogging, which has been conventionally encountered during the rapid solidification of an Fe—Cr—Al alloy, is avoided by adding Si. If the Si content is less than about 1.5 wt %, sufficient resistance to oxidation cannot be obtained even if not less than 0.07 wt % of REM is added in the production of foils having a thickness not more than 200 μm and, in addition, nozzle clogging tends to occur during rapid solidification. On the other hand, if the Si content exceeds about 3 wt %, although great improvement in the anti-oxidation properties could be assured, it is not possible to improve the workability even if rapid solidification is performed at a sufficiently high cooling speed to achieve a thickness of not more than 20 μm and a grain size of not more than 10 μm. Thus, the upper limit of the Si content is determined from the viewpoint of workability of the foil (the ability to be bent by 180°). It is known that the grains of a conventional rolled material become coarse (i.e., the grain size increases) when Si is added in an amount of about 1 wt % or more. This can result in the deterioration of workability and the peeling off of oxide scales. In contrast, according to the present invention, the cooling speed is great, and the grain size is small. Thus, workability is improved, and the oxide scale peeling properties are improved. FIG. 1 illustrates examples of such improvement, in which great improvements in life due to improved anti-oxidation properties were observed.

The melting point of an Fe—Cr—Al alloy is lowered by the addition of Si. However, if the Si content exceeds about 3 wt %, the effect is small. The addition of Si is also effective to the nozzle clogging when the content is about 1.5 to 3 wt %. Further, the Si added in an amount of not less than about 1.5 wt % serves, through the exothermic reaction of Si, to achieve a remarkable improvement yield of the REM.

REM (Y, Ce, La, Pr, Nd): about 0.07 to 2.0 wt %,

According to the present invention, at least one element selected from the group consisting of Y, Ce, La, Pr and Nd is added as rare-earth element(s). However, if the REM content is less than about 0.07 wt %, sufficient anti-oxidation properties cannot be obtained even if not less than 1.5 wt % of Si is added in the case of a foil having a thickness of not more than 200 μm. On the other hand, REM elements added in an amount exceeding about 2.0 wt % does not serve to improve the anti-oxidation properties, and involves the risk of nozzle clogging easily occurring during rapid solidification.

Ti, Nb, Zr, V: 0.001 to 0.5 wt %.

The addition of at least one of these elements is effective to refine the grain size and to improve resistance to peeling of oxide film generated in high-temperature environments. However, if the content of these element(s) Ti, Nb, Zr and V is less than about 0.001 wt %, significant effect is not provided. If the content exceeds about 0.5 wt %, oxidation occurs at higher speed. Therefore, the content of the element(s) Ti, Nb, Zr and V is limited within the range from about 0.001 to 0.5 wt %.

Next, reasons why the grain size is limited as above will be given.

The grain size of the foil is limited so as not to be more than 10 μm because the reduction in the toughness caused by the addition of Si must be compensated for from the viewpoint of workability. With the chemical composition according to the present invention, if the grain size exceeds 10 μm, the foil will be broken when bent in a 180° bending test.

The grain size of a foil can be controlled by the cooling speed during rapid solidification. For instance, if a single roll method is required to achieve a thickness of about 50 μm and a grain size of not more than 10 μm in order to produce by such a method a foil having only a few internal defects and having excellent surface properties, conditions such as the following should preferably be adopted: a roll peripheral speed of not less than about 18 m/sec; and a dimension of the roll-nozzle gap of not more than about 0.3 mm. In the case a relatively thick foil having a thickness of about 200 μm, if the roll peripheral speed and the dimension of the roll-nozzle gap are set at adequate values, the grain size can be controlled into a dimension of not more than 10 μm.

In the case of a foil having a thickness of 100 to 200 μm, it is possible to produce foils with a grain size of not more than 10 μm by a twin roll or melt drag method.

In a single roll method, because the dimension of the gap between the teeming nozzle and the cooling roll is very small (e.g., 0.1 to 1.5 mm) and because a slit-type nozzle is employed, nozzle clogging may occur easily. However, an Fe—Cr—Al alloy used in the present invention is advantageous when a single roll method is adopted, that is, it is possible to continuously produce an elongated and wide foil without entailing nozzle clogging.

One of the principal uses of an alloy foil according to the present invention is honeycomb materials used in an exhaust gas converter of a vehicle. If the foil has a less than about 20 μm, the foil fails, even with a chemical composition according to the present invention, to exhibit the anti-oxidation properties required by a use in a type of catalyst converter disposed immediately close to the engine. On the other hand, if the foil has a thickness exceeding about 80 μm, the resistance to the flow of exhaust gas may be increased, deteriorating the engine performance. Thus, a foil according to the present invention preferably has a thickness of from about 20 to 80 μm, both inclusive. For use in a more common type of catalyst converter (the type disposed below the floor), a resistor heater (electric heater), a radiation heater supporting body or the like, a foil can have a thickness of 200 μm at most, and the thickness is determined with consideration of workability. Thus, in view of such uses of a foil according to the present invention, the foil thickness preferably ranges from about 20 to 200 μm, both inclusive.

EXAMPLES

Example 1

Alloys having the chemical compositions shown in Tables 1-1 (Present invention) and 1-2 (Comparison example) were made into foils, each having a thickness of 50 μm, by employing the methods shown in the Tables, and the foils were examined with respect to their grain size, workability and anti-oxidation properties, as well as the occurrence of nozzle clogging. In the Tables, the circles in the column headlined by "REFERENCE" designate foils according to the present invention. The others are comparison examples.

Workability was examined by subjecting each (50-μm-thick) foil to bending by 180° degrees under the condition of R=0.2 mm. In Tables 1-1 and 1-2, those foils in which cracks were formed are designated by the symbol "X", and those foils in which no cracks were formed are designated by the symbol "o".

Anti-oxidation properties were examined in the following manner: first, each (50-μm-thick) foil was heated at 1200° C. in atmosphere; and then the time during which the degree of oxidation of each foil was not more than 2.0 mg/cm$^2$ was measured as the life until oxidation. The 1200° C. atmospheric oxidation test was a high oxidation-resistance accelerated test.

Samples Nos. 1 through 7 and No. 11 were each obtained as a sample having a width of 100 mm by ejecting a molten master alloy onto a single roll having a diameter of 500 mm and rotating in an argon atmosphere at a roll peripheral speed of 20 m/sec, thereby rapidly solidifying the alloy. Samples Nos. 12 and 13 were each obtained in the same manner as the above samples 1 through 7 and 11 except that the peripheral speed of the single roll was 18 m/sec and 15 m/sec, respectively. Although Samples Nos. 14 and 15 were each subjected to single-roll cooling under the same conditions as Samples Nos.1 to 7, nozzle clogging occurred, and formation into sheets was impossible. Sample No. 14 had a high Cr content of 35 wt %, and Sample No. 15 had a high La content of 3.0 wt %.

Samples Nos. 8 to 10 were each obtained as a foil having a width of 50 mm by ejecting a molten master alloy onto a twin roll having a diameter of 200 mm and rotating in an argon atmosphere at a roll peripheral speed of 30 m/sec. Samples Nos. 16 and 17 were each obtained in the same manner as the above samples 8 to 10 except that the peripheral speed of the twin roll was 10 m/sec. With respect to Sample No. 17, since the Si content was less than 1.5 wt % as in the case of Sample No. 12, nozzle clogging occurred, resulting in the foil being formed into a reed-screen-like shape having longitudinal slots.

Sample No. 18 was obtained by preparing a steel strip having a thickness of 0.3 mm and a width of 500 mm (prepared by ejection onto a twin roll having a diameter of 550 mm and rotating at a peripheral speed of 3 m/sec to effect rapid solidification), and thereafter performing cold rolling and hot rolling. Cracks were formed during the rolling, and it was impossible to roll the strip into a thickness of not more than 100 μm.

Samples Nos. 19 and 20 were each produced by a conventional process in which a vacuum melting furnace was used to obtain an ingot, and then the ingot was subjected to hot rolling to be formed into a hot coil. With respect to Sample No. 19, since large amounts of Si and La were added, edge cracks were formed, and it was impossible to obtain a sound hot coil. Thus, none of the subsequent processes and tests were performed. Although Sample No. 20 was able to be rolled, the resultant coil had a short life until oxidation, thereby involving practical problems regarding the use as the type disposed immediately close to an engine.

TABLE 1-1

(Present invention)

| No | PRODUCTION METHOD | (wt %) Cr | Al | Si | REM | OTHER | GRAIN SIZE (μm) | WORKABILITY (180° BENDING) | ANTI-OXIDATION PROPERTIES (LIFE) (hr) | NOZZLE CLOGGING | REFERENCE |
|---|---|---|---|---|---|---|---|---|---|---|---|
| 1 | Single Roll Method | 6 | 8 | 1.5 | La:1.0 Y:0.02 | | 5 | ○ | 200 | None | |
| 2 | Single Roll Method | 5 | 15 | 2.0 | Ce:0.1 | | 10 | ○ | 150 | None | |
| 3 | Single Roll Method | 20 | 5 | 2.0 | La:0.21 | Ti:0.05 | 7 | ○ | 144 or more | None | |
| 4 | Single Roll Method | 30 | 2 | 3.0 | La:0.4 | | 10 | ○ | 146 | None | |
| 5 | Single Roll Method | 30 | 8 | 3.0 | Ce:2.0 | Zr:0.1 | 8 | ○ | 450 | None | |
| 6 | Single Roll Method | 10 | 5 | 2.0 | La:0.07 | | 8 | ○ | 300 | None | *1 |
| 7 | Single Roll Method | 22 | 8 | 1.5 | La:0.07 | | 3 | ○ | 400 | None | *2 |
| 8 | Twin Roll Method | 20 | 5 | 1.5 | La:0.4 Ce:0.2 | | 10 | ○ | 150 | None | |
| 9 | Twin Roll Method | 15 | 4 | 3.0 | Nd:0.4 | | 5 | ○ | 150 | None | |
| 10 | Twin Roll Method | 5 | 2 | 1.5 | La:0.07 | Nb:0.05 V:0.05 | 10 | ○ | 145 | None | |

*1, *2: Examples in FIG. 1

TABLE 1-2

(Comparison example)

| No | PRODUCTION METHOD | (wt %) Cr | Al | Si | REM | OTHER | GRAIN SIZE (μm) | WORKABILITY (180° BENDING) | ANTI-OXIDATION PROPERTIES (LIFE) (hr) | NOZZLE CLOGGING | REF-ERENCE |
|---|---|---|---|---|---|---|---|---|---|---|---|
| 11 | Single Roll Method | 20 | 1 | 3.0 | La:1.0 | | 10 | ○ | 48 | None | |
| 12 | Single Roll Method | 15 | 3 | 1.0 | Ce:0.1 | | 15 | ○ | 72 | Clogged | Reed-screen Shaped |
| 13 | Single Roll Method | 15 | 5 | 3.0 | Nd:0.1 | | 30 | X | 96 | None | |
| 14 | Single Roll Method | 35 | 10 | 3.0 | La:0.3 | | — | — | — | Clogged | Sheet Form Impossible |
| 15 | Single Roll Method | 25 | 8 | 3.0 | La:3.0 | | — | — | — | Clogged | Sheet Form Impossible |
| 16 | Twin Roll Method | 5 | 5 | 1.5 | La:0.1 | | 40 | ○ | 24 | None | |
| 17 | Twin Roll Method | 15 | 3 | 0.2 | Nd:0.05 | | 40 | ○ | 48 | Clogged | Reed-screen Shaped |
| 18 | Twin Roll→ Cold Rolling | 20 | 5 | 1.5 | Ce:0.5 | | 30 | X | — | None | Cracks, 50 μm Impossible |
| 19 | Ingot→ Hot Rolling | 20 | 5 | 3.0 | La:0.6 | | 100 | X | — | — | Cracks |
| 20 | Ingot→ Hot Rolling | 20 | 5 | 0.1 | La:0.07 | | 20 | ○ | 75 | — | —*3 |

*3: Comparison Example in FIG. 1

Example 2

In the following examples, other foils having a thickness of 100 μm were produced for use in resistor heaters, and their life until oxidation was examined.

Present invention 1:

A foil having a chemical composition including: Cr: 30 wt %, Al: 15 wt %, Si: 3 wt %, and La: 0.1 wt %, and also having a width of 10 mm lasted for 600 hours in an atmospheric atmosphere at a temperature of 1150° C.

Present invention 2:

A foil having a chemical composition including: Cr: 20 wt %, Al: 12 wt %, Si: 1.5 wt %, and Y: 0.08 wt %, and also having a width of 10 mm lasted for 500 hours in an atmospheric atmosphere at a temperature of 1150° C.

Comparison Example 1:

A foil having a chemical composition including: Cr: 10 wt %, Al: 1.5 wt %, Si: 1 wt %, and La: 0.06 wt %, and also having a width of 10 mm lasted for 100 hours in an atmospheric atmosphere at a temperature of 1150° C.

Comparison Example 2:

A foil having a chemical composition including: Cr: 20 wt %, Al: 5 wt %, Si: 0.2 wt %, and La: 0.07 wt %, and also having a width of 10 mm lasted for 200 hours in an atmospheric atmosphere at a temperature of 1150° C.

Thus, when a foil is produced from the chemical composition as specified by the present invention, and performing rapid solidification in such a manner as to achieve a grain size of not more than about 10 μm, it is possible to provide a material which has excellent workability and anti-oxidation properties and which can be used even in exhaust gas catalyst converters.

What is claimed is:

1. A rapidly solidified Fe—Cr—Al alloy foil having excellent anti-oxidation properties, said foil essentially consisting of Cr: about 5 to 30 % by weight, Al: about 2 to 15% by weight, Si: about 1.5 to 3% by weight, and REM (Y, Ce, La, Pr, Nd): about 0.07 to 2.0% by weight, the balance being Fe and impurities, said foil having a grain size of not more than about 10 μm.

2. A rapidly solidified Fe—Cr—Al alloy foil having excellent anti-oxidation properties, said foil essentially consisting of Cr: about 5 to 30% by weight, Al: about 2 to 15% by weight, Si: about 1.5 to 3% by weight, REM (Y, Ce, La, Pr, Nd): about 0.07 to 2.0% by weight, and at least one element selected from the group consisting of Ti, Nb, Zr and V: about 0.001 to 0.5% by weight, the balance being Fe and impurities, said foil having a grain size of not more than about 10 μm.

3. A rapidly solidified Fe—Cr—Al alloy foil according to claim 1 or claim 2, said foil having a thickness of about 20 to 200 μm.

4. A rapidly solidified Fe—Cr—Al alloy foil having excellent anti-oxidation properties, said foil essentially consisting of Cr: about 5 to 30% by weight, Al: about 2 to 15% by weight, Si: about 1.5 to 3% by weight, and REM (Y, Ce, La, Pr, Nd): about 0.07 to 2.0% by weight, the balance being Fe and impurities, said foil having a width of not less than 50 mm and a grain size of not more than about 10 μm.

* * * * *